US005184328A

United States Patent [19]

Dumestre, III

[11] Patent Number: 5,184,328

[45] Date of Patent: Feb. 2, 1993

[54] UNDERWATER RELEASE MECHANISM

[75] Inventor: Alex Dumestre, III, Covington, La.

[73] Assignee: Navigation Technology Corporation, Covington, La.

[21] Appl. No.: 846,005

[22] Filed: Mar. 4, 1992

[51] Int. Cl.[5] ..... H04B 1/59; B63B 22/06; B63B 22/26

[52] U.S. Cl. ..... 367/4; 441/2; 441/33

[58] Field of Search ..... 367/4, 131, 133; 114/215, 216; 294/82.1, 82.17, 82.36; 441/2, 33

[56] References Cited

U.S. PATENT DOCUMENTS

| | | | |
|---|---|---|---|
| 1,538,315 | 5/1925 | Duffie . | |
| 2,594,702 | 4/1952 | Woodard | 177/385 |
| 2,739,296 | 3/1956 | Woodard | 340/3 |
| 3,066,325 | 12/1962 | Hayes | 9/8 |
| 3,125,975 | 3/1964 | Alsager et al. | 114/16 |
| 3,130,703 | 4/1964 | Thompson | 114/206 |
| 3,199,070 | 8/1965 | Baier, Jr. | 340/5 |
| 3,230,500 | 1/1966 | Dunn | 340/5 |
| 3,287,753 | 11/1966 | Race | 9/8 |
| 3,293,676 | 12/1966 | Link | 9/8 |
| 3,329,799 | 7/1967 | Carmody | 219/200 |
| 3,382,514 | 5/1968 | Boscov | 9/8 |
| 3,402,687 | 9/1968 | Tsuji | 114/16 |
| 3,415,317 | 12/1968 | Drivet | 166/0.6 |
| 3,434,446 | 3/1969 | Cole | 114/235 |
| 3,487,486 | 1/1970 | Leonard et al. | 9/8 |
| 3,553,795 | 1/1971 | McDougal | 24/201 |
| 3,560,912 | 2/1971 | Spink et al. | 340/3 |
| 3,605,674 | 9/1971 | Weese | 114/235 B |
| 3,611,975 | 10/1971 | Ashbrook | 114/235 B |
| 3,638,722 | 2/1972 | Talley, Jr. | 166/0.5 |
| 3,722,014 | 3/1973 | Hill et al. | 9/8 |
| 3,742,440 | 6/1973 | Ehrlich et al. | 340/5 T |
| 3,749,933 | 7/1973 | Davidson | 441/2 |
| 3,773,109 | 11/1973 | Eberline | 166/54.5 |
| 3,774,570 | 11/1973 | Pearson | 114/235 B |
| 3,775,736 | 11/1973 | Koomey | 340/5 R |
| 3,793,685 | 2/1974 | Knecht | 24/230 AN |
| 3,842,770 | 10/1974 | Hedbawny et al. | 114/20 B |
| 3,848,226 | 11/1974 | Perez | 441/2 |
| 3,889,307 | 6/1975 | Houot | 9/8 R |
| 3,896,756 | 7/1975 | Pearson et al. | 114/235 B |
| 4,021,638 | 5/1977 | Asakura | 219/200 |
| 4,024,491 | 5/1977 | Pellerin et al. | 340/5 R |
| 4,097,837 | 6/1978 | Cyr | 340/5 C |
| 4,110,726 | 8/1978 | Dorrance et al. | 340/6 R |
| 4,136,415 | 1/1979 | Blockburger | 441/2 |
| 4,189,786 | 2/1980 | Adler | 367/4 |
| 4,215,633 | 8/1980 | Anderson et al. | 102/210 |
| 4,430,552 | 2/1984 | Peterson | 219/200 |
| 4,540,873 | 9/1985 | Kester | 219/200 |
| 4,839,873 | 6/1989 | Cochrane, Jr. et al. | 367/133 |
| 4,843,996 | 7/1989 | Darche | 114/245 |
| 5,022,013 | 6/1991 | Dalton et al. | 367/4 |

FOREIGN PATENT DOCUMENTS

| | | | |
|---|---|---|---|
| 0990580 | 1/1983 | U.S.S.R. | 441/33 |

*Primary Examiner*—Ian J. Lobo

*Attorney, Agent, or Firm*—Pravel, Gambrell, Hewitt, Kimball & Krieger

[57] ABSTRACT

An underwater acoustic release system includes a buoyed member with an attached line that is released from a preselected underwater location using an acoustic signal that activates a heating element to melt a volume of wax or like meltable substance. The wax expands, pushing a cylinder or like linkage to release the buoy and its attached line so that it rises to the surface identifying the location for a survey vessel.

18 Claims, 2 Drawing Sheets

UNDERWATER RELEASE MECHANISM

BACKGROUND OF THE INVENTION

1. Field Of The Invention

The present invention relates to underwater release mechanisms and more particularly relates to an improved underwater release mechanism that uses a meltable substance such as wax that expands upon transformation from a solid to a liquid state, wherein the expansion operates a cylinder or the like for mechanically releasing a length of rope and buoy that rise to the water surface.

2. General Background

In seismic exploration and in oceanographic research, there is often employed an underwater acoustic transponder. Many acoustic release devices employ linkages that are complicated and expansive. Such complicated linkages often fail in the harsh underwater environment of oceanographic research and/or seismic exploration.

The following patents are known to Applicant, all of which relating to underwater acoustic devices and/or underwater marker devices

| PATENT NO. | TITLE | ISSUE DATE |
|---|---|---|
| 2,594,702 | RETRIEVABLE MARINE MARKER | 04/29/52 |
| 2,739,296 | MARINE MARKER | 03/20/56 |
| 3,066,325 | REPLACEABLE MARINE MARKER | 12/04/62 |
| 3,125,975 | SUBMERGIBLE HULL PROPULSION AND CONTROL SYSTEMS | 03/24/64 |
| 3,130,703 | PERCUSSION RELEASE HOOK | 04/28/64 |
| 3,199,070 | SONIC CONTROL CIRCUITRY | 08/03/65 |
| 3,230,500 | TRANSMISSION OF TELEPHONY SPECTRUM OVER VLF CHANNELS | 01/18/66 |
| 3,287,753 | OCEANOGRAPHIC APPARATUS | 11/29/66 |
| 3,293,676 | INSTRUMENT CAPSULE | 12/27/66 |
| 3,382,514 | POSITIVE SCUTTLING BUOY | 05/14/68 |
| 3,402,687 | DEPTH-POSITIONING APPARATUS FOR UNDERWATER RESEARCH VEHICLES | 09/24/68 |
| 3,415,317 | EQUIPMENT FOR WIRE-LINING OPERATIONS IN SUBMARINE WELL DRILLINGS | 12/10/68 |
| 3,487,486 | REMOTELY CONTROLLED UNDER-WATER BUOY | 01/06/70 |
| 3,553,795 | HYDRAULIC LATCH | 01/12/71 |
| 3,638,722 | METHOD AND APPARATUS FOR REENTRY OF SUBSEA WELL-HEADS | 02/01/72 |
| 3,722,014 | RETRIEVABLE BUOY | 03/27/73 |
| 3,742,440 | SYSTEM FOR ACTIVATING A REMOTE UNDERWATER DEVICE | 06/26/73 |
| 3,775,736 | ACOUSTICAL UNDERWATER CONTROL APPARATUS | 11/27/73 |
| 3,793,685 | COUPLING APPARATUS FOR THE MOORING OF BOATS OR THE LIKE | 02/26/74 |
| 3,889,307 | REMOTE-CONTROLLED UNDERWATER BUOY | 06/17/75 |
| 4,024,491 | WIRELESS MARINE NAVIGA-TIONAL AID SYSTEM | 05/17/77 |
| 4,097,837 | UNDERWATER TRANSPONDER CALIBRATION ARRANGEMENT | 06/27/78 |
| 4,110,726 | NAVIGATION SYSTEM AND METHOD FOR DETERMINING THE POSITION OF AN OCEAN MINING SHIP | 08/29/78 |

Explosive charges have been used as part of the release mechanism such as is discussed in the Hill U.S. Pat. No. 3,722,014. A recall transmitter located above the water actuates a plurality of sound sources, such as explosive charges which provide a series of mechanical signals in a predetermined time sequence to provide a coded recall command, and the buoy includes a receiver which receives these mechanical signals and when the properly coded recall command is received actuates the explosive charge release mechanism to release the buoy and cause it to ascend.

Spring-loaded latching dogs in the marine marker is the subject of U.S. Pat. No. 3,066,325 entitled "Replaceable Marine Marker". By supplying fluid pressure through a line, a piston rod is moved up or down to actuate a release mechanism. The buoy apparatus is adapted to be secured under water, being releasably secured to a base. The buoy apparatus includes a buoyancy tank, a buoy line holder position below the tank, a buoy line adapted to be stored in a holder and the release latching mechanism.

Another hydraulically operated latch mechanism is seen in the McDougal U.S. Pat. No. 3,553,795 entitled "Hydraulic Latch".

SUMMARY OF THE PRESENT INVENTION

The present invention provides an improved acoustic release mechanism that includes a housing with a spool section on the housing for carrying a length of rope that is extendable between the sea surface area and an underwater location. The device includes a release module carried by the housing and including a connector that can engage an end portion of the rope so that it will not unwind from the spool section.

A releasable connector engages the rope and includes a meltable substance that can expand upon melting, the expanding meltable substance powering a link such as a hook connector.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

FIGURE is a schematic view of the preferred embodiment of the apparatus of the present invention.

DETAILED DESCRIPTION OF THE PREFERRED EMBODIMENT

Figure 1:
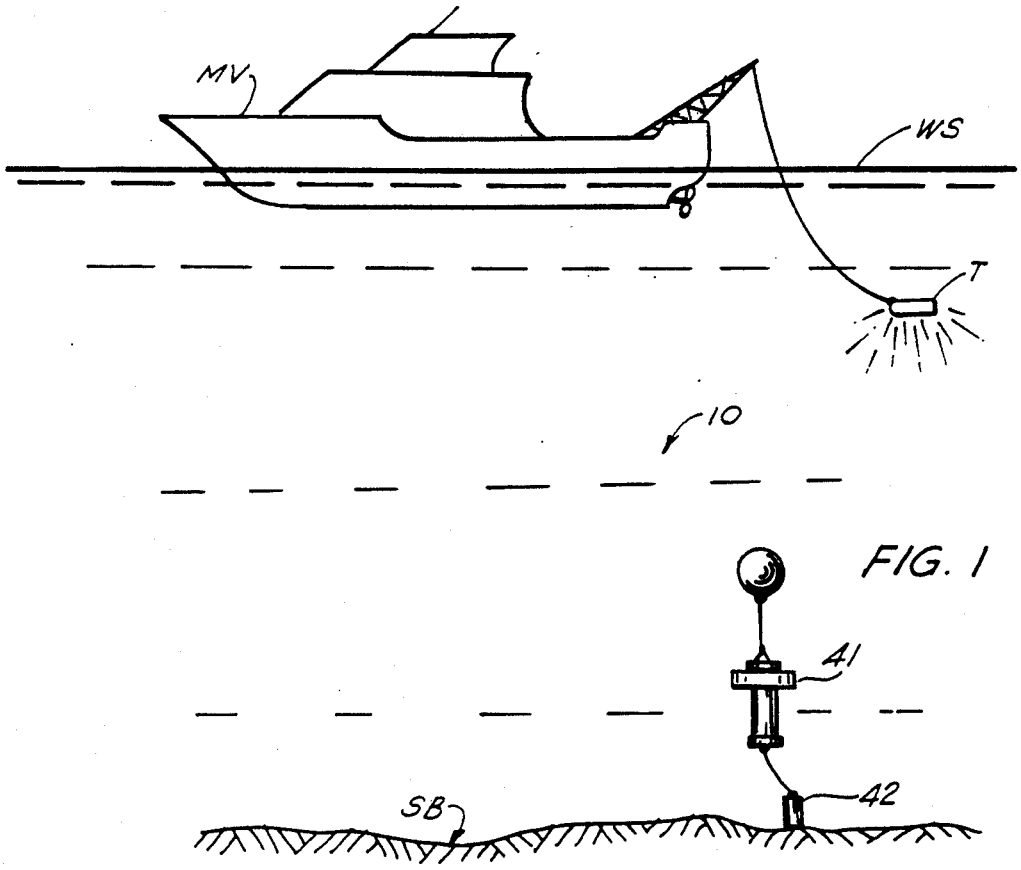
Figure 2:
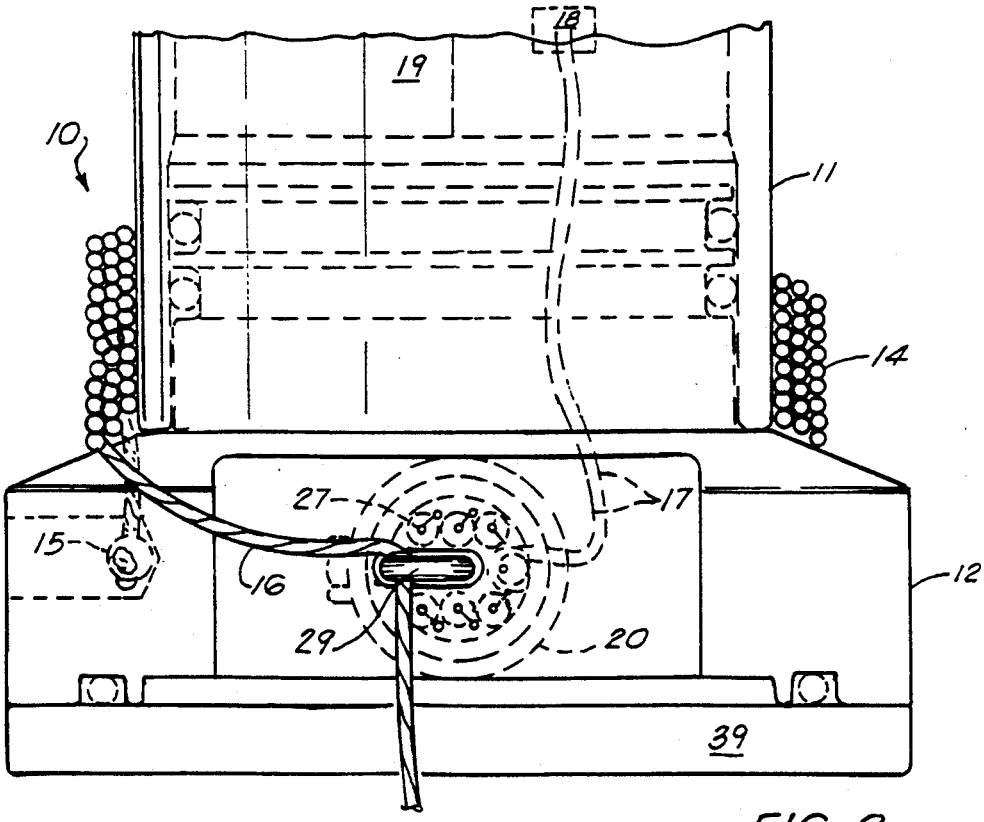
FIG. 2 is a partial side view of the preferred embodiment of the apparatus of the present invention.
Figure 3:
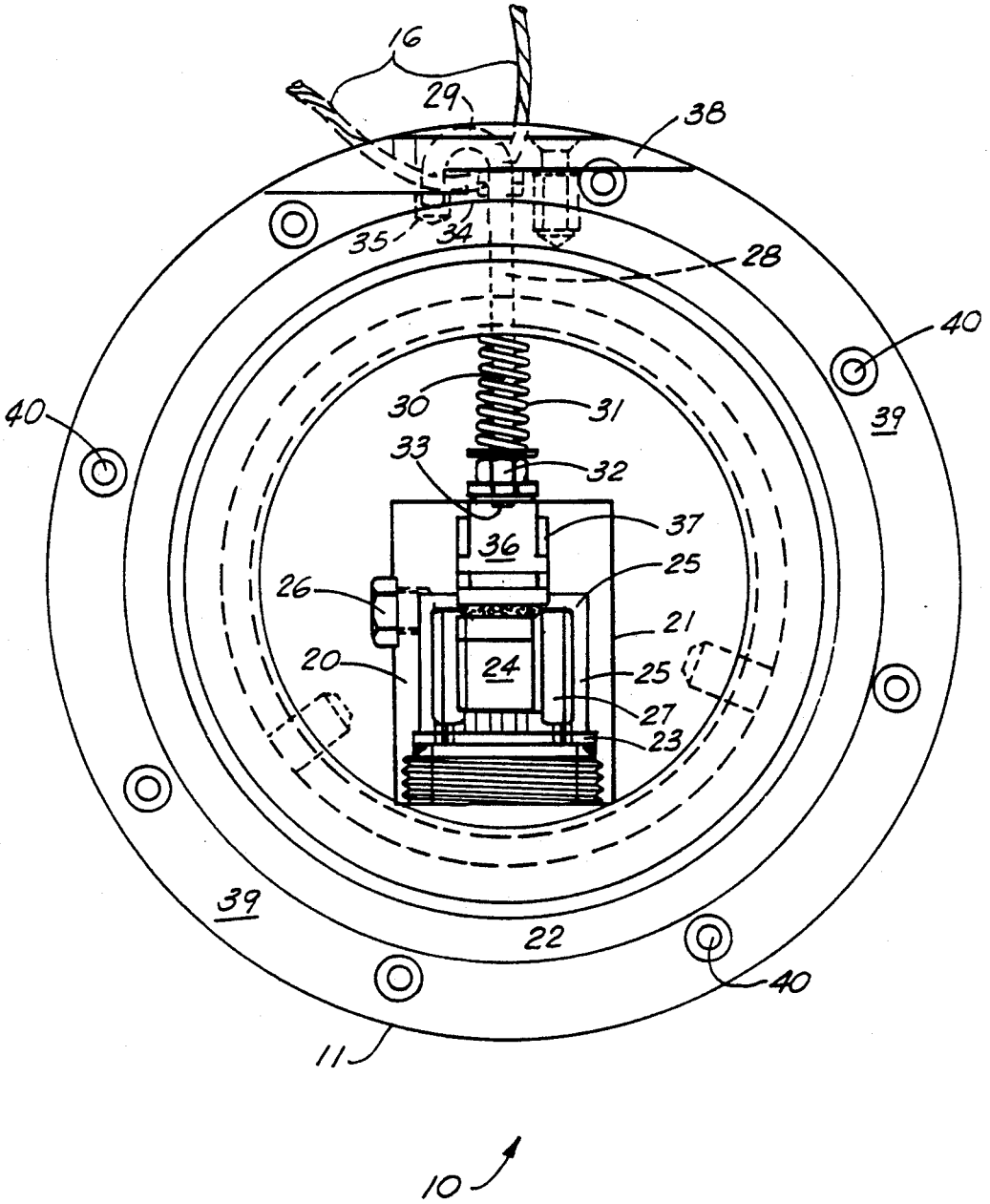
FIG. 3 is a transverse sectional view of the preferred embodiment of the apparatus of the present invention.

FIGS. 1-3 illustrate the preferred embodiment of the apparatus of the present invention designated generally by the numeral 10 Acoustic release apparatus 10 includes a housing 11 having enlarged end portions 12. The housing 11 includes a center section 13 in the form of a spool. The center spool section 13 carries a wound section of rope 14 wrapped around it numerous times so that the length of rope is sufficient to extend between an object being marked such as the seabed and the water surface. Thus, for example the rope would be several hundred feet in length if necessary.

Rope 14 includes a rope tie off 15 attached to the housing 11 and a rope free end 16.

Control wires 17 extend between battery 18 and electronics module 19. Battery 18 provides power for activating release activator 20 and more particularly the resistor heating elements 27. The release activator 20 includes a release housing 21 having an end cap 22. A printed circuit board 23 and solid state switch 24 comprise the electronics within the release housing 21. A wax or other suitable substance 25 is contained within release housing 21, added through filling port 26 which can be sealed. A plurality of resister heating elements 27 are spaced over the area occupied by wax 25 J hook 28 provides a hook distal end 29 for engaging the free end 16 of the rope 14. A hook proximal end 30 carries a spring 31 which urges the J hook 28 into an engaged position as shown in the drawings wherein the hook 28 grips the rope 14 preventing an unwinding of the rope 14 from the spool section 13.

When the resistor heating elements 27 are activated, the wax 25 melts and expands. An expansion of approximately 15 percent is obtained for example using most common waxes. An adjustment nut 32 can be used to adjust the position of the J hook 28 with regard to the rope free end 16. Adjustment nut 32 mounts upon the threaded section 33 of J hook 28. Hook support 34 supports the J hook 28 at its distal end and adjacent the position wherein the J hook 28 engages the rope free end 16. This prevents inadvertent movement of the J hook which might disengage the hook 28 and the free end 16 of the rope 14 inadvertently. A recess 35 is provided for the hook 28 distal end 29. Piston 36 expands when the wax 25 or other meltable substance melts. The chamber 37 abuts the piston 36 and contains the wax 25. When the wax melts, the piston 36 expands, pushing the J hook 28 outwardly with respect to the housing This disengages the hook 28 from the free end 16 of the rope 14. Piston 36 travels in chamber 37. The hook distal end 29 clears the surface 38 in order to reach the disengaged position which frees the free end 16 of the rope 14. The end of housing adjacent release activator 20 can be closed using closure cap 39 and a plurality of assembly bolts 40. The wax release device of the present invention is a simple, durable design and can operate at the very high hydro-static pressures involved in deep ocean applications.

The following table list the parts used in this written specification and in the drawings by identifying the part number and its corresponding part description.

PARTS LIST

| Part Number | Description |
|---|---|
| 10 | acoustic release apparatus |
| 11 | housing |
| 12 | enlarged ends |
| 13 | center spool section |
| 14 | rope |
| 15 | rope tie off |
| 16 | rope free end |
| 17 | control wires |
| 18 | battery |
| 19 | electronics module |
| 20 | release activator |
| 21 | release housing |
| 22 | end cap |
| 23 | printed circuit board |
| 24 | solid state switch |
| 25 | wax |
| 26 | filling port |
| 27 | resistor heating element |
| 28 | J-hook |
| 29 | hook distal end |
| 30 | hood proximal end |
| 31 | spring |
| 32 | adjustment nut |
| 33 | threaded section |
| 34 | hook support |
| 35 | recess |
| 36 | piston |
| 37 | chamber |

-continued

PARTS LIST

| Part Number | Description |
|---|---|
| 38 | surface |
| 39 | closure cap |
| 40 | assembly bolts |
| 41 | buoy |
| 42 | anchor |
| WS | water surface |
| SB | seabed |
| MV | motor vessel |
| T | transmitter |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An underwater acoustic release mechanism for use in high hydro-static pressures, comprising:

a) a housing;

b) a spool section of the housing for carrying a length of rope for extension between the sea surface area and an underwater location;

c) a release module carried by the housing and including a connector that can engage an end portion of the rope so that it will not unwind from the spool section;

d) means for releasing the connector from engagement with the rope and comprising in part a meltable substance that can expand upon melting; and e) linkage means for translating an expansion of the meltable substance into movement of the connector.

2. The apparatus of claim 1 wherein the release module includes a container for holding a volume of the meltable substance.

3. The apparatus of claim 1 wherein the linkage means includes a movable piston.

4. The apparatus of claim 1 wherein the linkage means comprises a piston, and a pushrod connected to the piston for movement therewith, the end of the pushrod having the connector for engaging the rope.

5. The apparatus of claim 1 wherein the releasing means comprises a chamber, a meltable substance filling at least a portion of the chamber, a piston occupying a portion of the chamber adjacent the meltable substance, and a pushrod extending between the piston and the connector.

6. The apparatus of claim or 5 wherein the meltable substance is a wax material.

7. The apparatus of claim 1 or 5 wherein the rope is wound on the exterior of the housing which exterior defines the spool section.

8. The apparatus of claim wherein there is further provided a hook portion of the connector with engages the rope.

9. The apparatus of claim 1 wherein the release means includes a heating element for melting the meltable substance, and a battery carried by the housing for activating the heating element.

10. An underwater acoustic release mechanism, comprising:

a) a housing;

b) a spool section of the housing for carrying a length of rope for extension between the sea surface area and an underwater location;

c) a release module carried by the housing and including a connector that can engage an end portion of the rope so that it will not unwind from the spool section;

d) means for releasing the connector from engagement with the rope and comprising in part a chemical substance that expands in response to a phase change; and e) linkage means for translating an expansion of the substance into movement of the connector.

11. The apparatus of claim 10 wherein the release module includes a container for holding a volume of the chemical substance.

12. The apparatus of claim 10 wherein the linkage means includes a movable piston.

13. The apparatus of claim 10 wherein the linkage means comprises a piston, and a pushrod connected to the piston for movement therewith, the end of the pushrod having the connector for engaging the rope.

14. The apparatus of claim 10 wherein the releasing means comprises a chamber, a meltable substance filling at least a portion of the chamber, a piston occupying a portion of the chamber adjacent the meltable substance, and a pushrod extending between the piston and the connector.

15. The apparatus of claim 10 or 14 wherein the chemical substance is a petroleum derivative material.

16. The apparatus of claim 10 or 14 wherein the rope is wound on the exterior of the housing which exterior defines the spool section.

17. The apparatus of claim 10 wherein there is further provided a hook portion of the connector with engages the rope.

18. The apparatus of claim 10 wherein the release means includes a heating element for melting the chemical substance, and a battery carried by the housing for activating the heating element.

* * * * *